United States Patent [19]

Föhl

[11] 4,329,758

[45] May 18, 1982

[54] HINGE CONSTRUCTION

[75] Inventor: Artur Föhl, Schorndorf, Fed. Rep. of Germany

[73] Assignee: Repa Feinstanzwerk GmbH, Alfdorf, Fed. Rep. of Germany

[21] Appl. No.: 113,055

[22] Filed: Jan. 17, 1980

[30] Foreign Application Priority Data

Jan. 17, 1979 [DE] Fed. Rep. of Germany ..... 2901691

[51] Int. Cl.[3] ..... E05D 5/14

[52] U.S. Cl. ..... 16/273; 16/385; 16/387

[58] Field of Search ..... 16/DIG. 13, 136, 148, 16/168, 128.1; 403/157, 159, 209

[56] References Cited

U.S. PATENT DOCUMENTS 3,991,436 11/1976 Nagase ..... 16/136
4,175,315 11/1979 Hayes, Sr. et al. ..... 16/DIG. 13

FOREIGN PATENT DOCUMENTS 2100164 7/1972 Fed. Rep. of Germany ..... 16/136
2406706 8/1975 Fed. Rep. of Germany .
2419155 11/1975 Fed. Rep. of Germany .... 16/DIG. 13
885300 12/1961 United Kingdom ..... 16/DIG. 13
902488 8/1962 United Kingdom ..... 16/136

*Primary Examiner*—Werner H. Schroeder
*Assistant Examiner*—Andrew M. Falik
*Attorney, Agent, or Firm*—Herbert L. Lerner; Laurence A. Greenberg

[57] ABSTRACT

Door hinge, including two mounting plates each having at least one eye-shaped extension formed thereon, the extensions being alternatingly disposed along a common hinge axis and having inner bearing surfaces and lateral contact surfaces spaced apart from each other, a hinge pin disposed in the extensions on the bearing surfaces for holding the extensions together, and a plastic covering disposed on the extensions and covering the bearing surfaces and the lateral contact surfaces.

5 Claims, 5 Drawing Figures a
b

HINGE CONSTRUCTION

The present invention relates to a door hinge, especially for motor vehicles, comprising two mounting plates which have extensions that are formed in eye-fashion, interleaved along a common hinge axis, and are coated with plastic including the bearing points for a hinge shaft which holds the extensions together.

In a known door or frame part for a hinge plate disclosed in German Published, Non-Prosecuted Application DEOS No. 24 06 706, which is formed in the hereinafore mentioned manner from substantially flat mounting plates and extensions that are formed in eye- or sleeve fashion and are joined together by a hinge pin, only the extensions thereof which project in toothfashion from the mounting plates are provided with a covering of plastic. At least one cap which is matched to the shape of the plate and/or to the shape of the door or the frame, and/or matched to the other installation condition, which is preferably formed of plastic, is placed on the mounting plates. The extensions of the one mounting plate, which project in the form of teeth beyond the mounting plate, are inserted with practically no play and flush into the gaps between corresponding tooth-like extensions of the other mounting plate, disposed at a distance from each other. This is done so that the lateral boundary edges of these eye-like extensions essentially support each other under the load of the door and form contact surfaces. This results in a relatively high contact pressure as well as in mechanical abrasion of the metal parts sliding on each other which are not inconsiderable and can lead prematurely to undesirable axial bearing clearance.

It is accordingly an object of the invention to provide a door hinge, especially for motor vehicles, which overcomes the hereinafore mentioned disadvantages of the heretofore known devices of this generally type with respect to mechanical load-carrying capacity and service life, and to simplify its manufacture.

With the foregoing and other objects in view there is provided, in accordance with the invention, a door hinge, especially for motor vehicles, comprising two mounting plates each having at least one eye-shaped extension formed thereon, the extensions being alternatingly interleaved tooth-like and disposed along a common hinge axis and having inner bearing surfaces and lateral contact surfaces spaced apart from each other, a hinge pin disposed in the extensions on the bearing surfaces for holding the extensions together, and a plastic covering disposed on the extensions and covering the bearing surfaces and the lateral contact surfaces. At the respective lateral boundary edges of the extensions, there is accordingly obtained relatively large and homogeneous contact surfaces of highly resistant plastic, together with a contact pressure which is low in comparison with conventional door hinges. This has a positive effect on the service life and the load carrying capacity of the door hinge. Due to the actually complete covering of the extensions on all sides, the bond between metal and plastic is improved and the plastic covering is prevented from lifting off metallic base material. Particularly good sliding properties in conjunction with very low wear are obtained in accordance with another feature of the invention, wherein there are provided metal washers disposed between the contact surfaces.

In accordance with a further feature of the invention, the plastic covering is heat resistant to a temperature of at least 200° C. Plastics with the trademarks Ultramid and Ultradur have proven themselves to be advantageous in practice. The special choice of the plastic covering makes it possible, for instance, to subject the vehicle body, together with the already-mounted door hinges, to a varnish-baking operation.

In accordance with an added feature of the invention, at least one of the mounting plates has an outer surface, the at least one extension formed on the at least one mounting plate being disposed tangentially thereto, and the plastic covering being disposed flush with the outer surface. Through the flush transition of plastic covering and outer plate surface, there is provided a possibility of fastening the mounting plates directly to the body frame, and of doing this without the use of a spacer or a cap over a large surface, for instance.

The mechanical strength of the hinge joint is further increased in accordance with an additional feature of the invention, wherein the mounting plates have openings formed therein, and the extensions have free ends with detent tabs integral therewith, the tabs being secured in the openings. Particularly efficient and material-saving production of the door hinge according to the invention is made possible if, in accordance with yet another feature of the invention, there is provided a strip-shaped punching strip, the mounting plates being punched-out of the punching strip, and the extensions being alternatingly or interleavedly punched-out of the punching strip.

In accordance with a concomitant feature of the invention, the extensions are of equal length.

Other features which are considered as characteristic for the invention are set forth in the appended claims.

Although the invention is illustrated and described herein as embodied in a door hinge, especially for motor vehicles, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figures 1, 2, 3, 4:
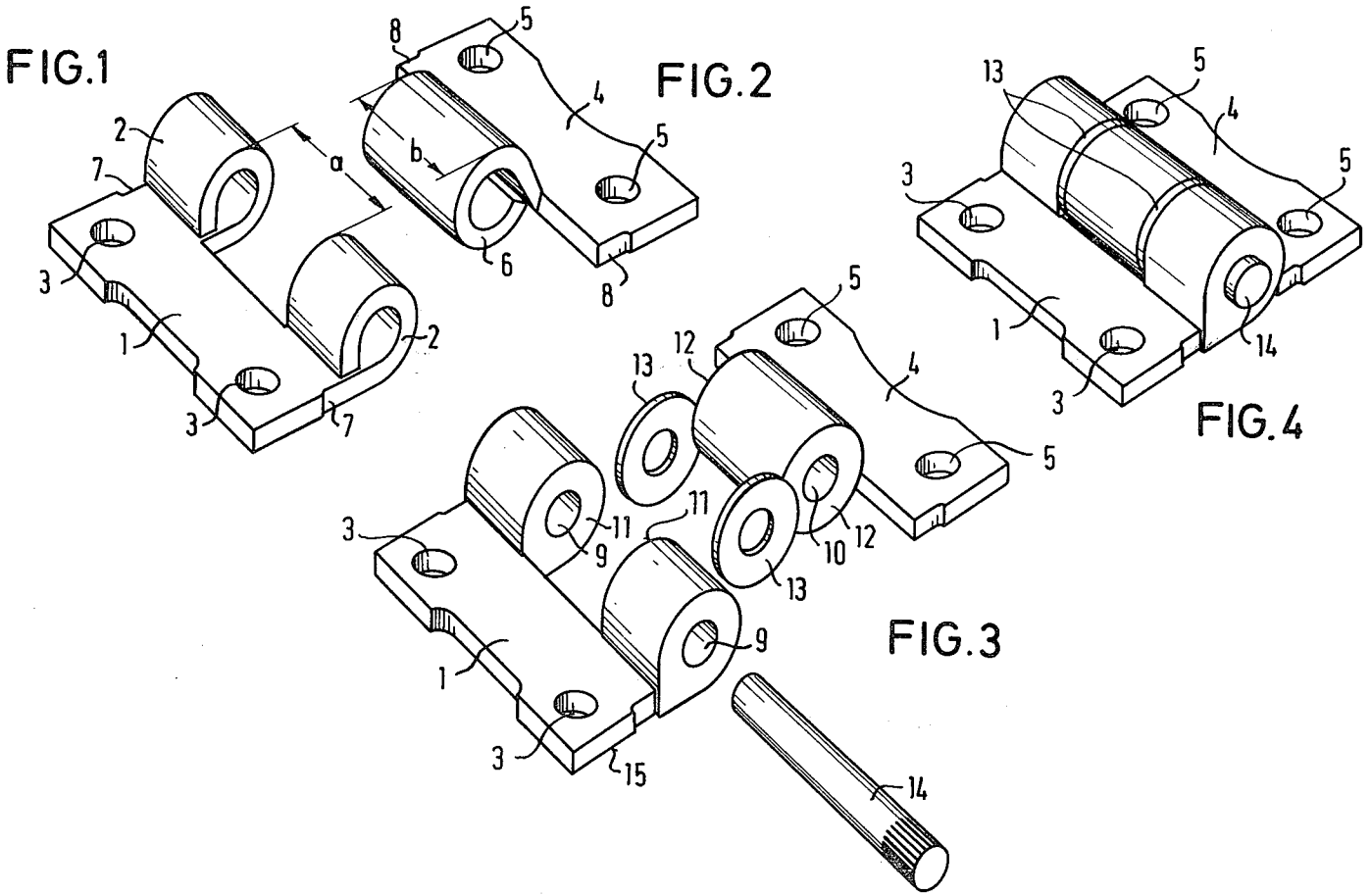
FIGS. 1 and 2 are diagrammatic perspective views of two mounting plates of the door hinge according to the invention, shown as individual parts without plastic coverings.
FIG. 3 is an exploded diagrammatic perspective view of the individual parts of the door hinge according to the invention, which are ready for installation.
FIG. 4 is a similar view of the completely assembled door hinge.

Referring now to the figures of the drawing and first, particularly, to FIG. 1 thereof, there is seen a flat mounting plate 1 which is made of sheet metal and has strip-like extensions 2 which are integrally connected thereto, arranged at a mutual spacing from each other and bent in eye-fashion. The mounting plate 1 adjoins its extensions 2 tangentially, as can clearly be seen in FIG.

1. The mounting plate 1 has two mounting holes 3 which serve for fastening the assembled hinge to the body frame of a motor vehicle, for instance. In FIG. 2, the corresponding matching piece of the door hing is shown to be in the form of a flat mounting plate 4 with two mounting holes 5; this mounting plate 4 has only one extension 6, bent in eye-fashion. This eye-shaped extension 6 is constructed in such a way that the mounting plate 4 is located approximately at the height of the center of the circular plane. The width b of the eye-like extension 6 is smaller than the distance a between the two extensions 2 of the mounting plate 1. The mounting plates 1 and 4, as well as the extensions 2 shown in FIG. 1, have lateral, narrowed-down steps 7 and 8.

As shown in FIG. 3, the extensions 2 and 6 (which are shown in FIGS. 1 and 2) that extend beyond the mounting plates 1 and 4, are alone provided with coverings on all sides thereof. A covering plastic is used thereon which is heat-resistant up to a temperature of about 200° C. The covering on all sides of the extensions 2 and 6 forms, on the one hand, plastic bearings 9 and 10, and on the other hand, planar and relatively large-area plastic contact surfaces 11 and 12. The distance between the contact surfaces 11 of the mounting plate 1 facing each other, is chosen with respect to the distance between the contact surfaces 12 of the mounting plate 4, in such a manner that a metal washer 13 is insertable between each of the corresponding contact surfaces 11 and 12. Reference numeral 14 designates a hinge pin which holds the coated extensions 2 and 6, joined together in tooth-fashion, together with the metal washers 13, and allows them to be swung about the hinge pin 14. The completely assembled door hinge is shown in FIG. 4.

As is evident from FIGS. 3 and 4, the plastic covering of the extensions 2 of the mounting plate 1 is constructed so that it adjoins the outer plate surface 15 of the flat mounting plate 1 and is flush and without steps. The presence of the steps 7 at the mounting plate 1 as well as at its extensions 2, makes it possible for the plastic covering to completely enclose the extensions 2 at the outer boundary edges without extending beyond the width of the mounting plate 1.

Figure 5:
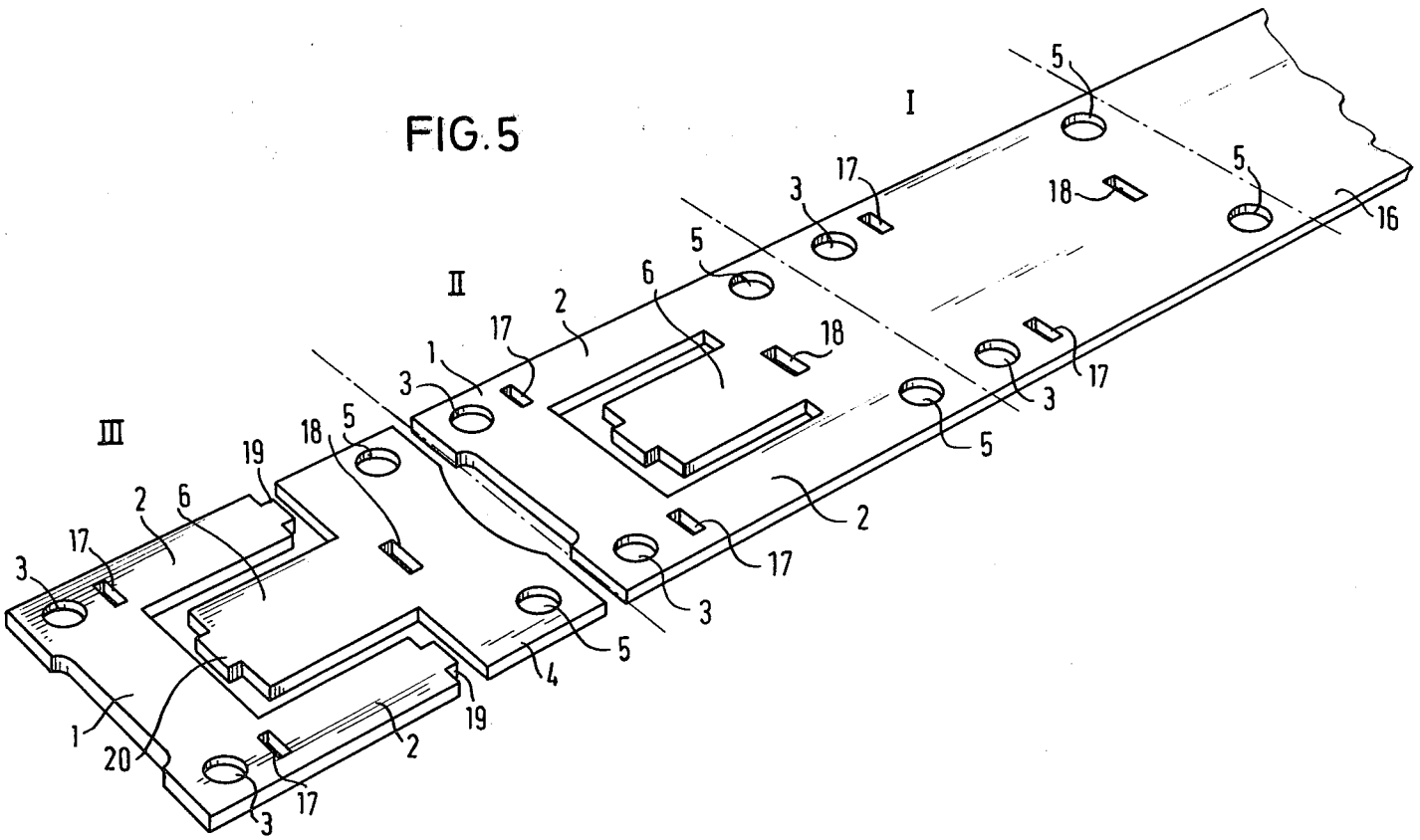
FIG. 5 is a diagrammatic perspective view of a punching strip for manufacturing the mounting plates required for the door hinge according to the invention, which makes the successive punching operations clear.

In FIG. 5, there is seen a strip-shaped punching strip designated with reference numeral 16, from which the mounting plates 1 and 4 together with their extensions 2 and 6 are stamped in multiple press operations; the individual successive cutting sequences being designated with numerals I, II and III. The stamping pattern is laid out in a material-saving manner so that, as shown in sequence III, the extensions 2 and 6, which are of equal length in the embodiment example of the mounting plates 1 and 4, engage each other with little spacing; the width of the punching strip 16 corresponding to the width of the mounting plates 1 and 4. In sequence I, the mounting holes 3 and 5 as well as rectangular openings 17 and 18, associated with the two mounting plates 1 and 4, are punched into the punching strip 16. In the next sequence II, the outline of the mounting plate 1 as well as the inner outline of the extension 2 and of the extension 6 are punched free. In the last sequence III, the two mounting plates 1 and 4 are separated from each other by a stamping operation. The stamping pattern is laid out so that detent tabs 19 and 20 are formed at the free ends of the extensions 2 and 6. These detent tabs 19 and 20 are secured in the openings 17 and 18, respectively, when the extensions 2 and 6 are formed into eyes. The steps 7 and 8 can easily be punched off from the sides of the plates 1 and 4 before the extensions are formed into eyes.

There is claimed:

1. Door hinge, comprising two mounting plates each having at least one eye-shaped extension formed thereon, said extensions being alternatingly disposed along a common hinge axis and having inner bearing surfaces and lateral contact surfaces spaced apart from each other, a hinge pin disposed in said extensions on said bearing surfaces for holding said extensions together, and a plastic covering disposed on said extensions and covering said bearing surfaces and said lateral contact surfaces, said mounting plates having openings formed therein, and said extensions having free ends with detent tabs integral therewith, said tabs being secured in said openings.

2. Door hinge according to claim 1, including metal washers disposed between said contact surfaces.

3. Door hinge according to claim 1, wherein said plastic covering is heat resistant to a temperature of at least 200° C.

4. Door hinge according to claim 1, wherein at least one of said mounting plates has an outer surface, said at least one extension formed on said at least one mounting plate being disposed tangentially thereto, and said plastic covering being disposed flush with said outer surface.

5. Door hinge according to claim 1, wherein said extensions are of equal length.

* * * * *